US010362856B2

(12) United States Patent
Parsons et al.

(10) Patent No.: US 10,362,856 B2
(45) Date of Patent: Jul. 30, 2019

(54) CARRYING CASE FOR POLICE OR MILITARY EQUIPMENT

(71) Applicant: Armament Systems and Procedures, Inc., Appleton, WI (US)

(72) Inventors: Kevin Parsons, Appleton, WI (US); Siu Ngai Wang, Kowloon (HK)

(73) Assignee: Armament Systems and Procedures, Inc., Appleton, WI (US)

( * ) Notice: Subject to any disclaimer, the term of this patent is extended or adjusted under 35 U.S.C. 154(b) by 1057 days.

(21) Appl. No.: 14/072,261

(22) Filed: Nov. 5, 2013

(65) Prior Publication Data

US 2015/0122863 A1 May 7, 2015

(51) Int. Cl.
*A45F 5/02* (2006.01)

(52) U.S. Cl.
CPC ..... *A45F 5/021* (2013.01); *A45F 2200/0575* (2013.01); *A45F 2200/0591* (2013.01)

(58) Field of Classification Search
CPC ..... A45F 5/021; A45F 2200/0575; A45F 2200/0591
USPC ..... 224/232–233, 666–667, 677, 914
See application file for complete search history.

(56) References Cited

U.S. PATENT DOCUMENTS

| | | | | |
|---|---|---|---|---|
| 4,773,578 | A * | 9/1988 | Braun | 224/666 |
| 5,217,151 | A * | 6/1993 | Parsons | 224/672 |
| 5,839,630 | A * | 11/1998 | Dunstan et al. | 224/197 |
| 6,145,169 | A * | 11/2000 | Terzuola et al. | 24/170 |
| 6,443,343 | B2 * | 9/2002 | Kamiya | 224/269 |
| 7,331,872 | B1 * | 2/2008 | Parsons | 463/47.2 |
| 2003/0085244 | A1 * | 5/2003 | Parsons | 224/197 |
| 2003/0141329 | A1 * | 7/2003 | Huang | 224/197 |
| 2005/0077332 | A1 * | 4/2005 | Parsons | 224/197 |
| 2007/0090138 | A1 * | 4/2007 | Parsons | 224/197 |
| 2007/0226958 | A1 * | 10/2007 | Clifton, Jr. | 24/3.12 |
| 2007/0235481 | A1 * | 10/2007 | Parsons | 224/197 |
| 2010/0264177 | A1 * | 10/2010 | Clifton, Jr. | 224/269 |
| 2012/0074184 | A1 * | 3/2012 | Morgan et al. | 224/222 |

* cited by examiner

*Primary Examiner* — Scott T McNurlen
(74) *Attorney, Agent, or Firm* — Hahn Loeser & Parks, LLP

(57) ABSTRACT

A holster system including an elongated backer plate having a plurality of slots, a hinge that pivotally connects a first end of the backer plate to a first end of the cover plate, a resilient lock that releasably connects a second end of the backer plate to the second of the cover plate, an adjustable spacer located between the backer plate and cover plate, the cover plate, the hinge and resilient lock is adapted to accept a range of different sizes of belts worn by a human user and wherein the adjustable spacer may be inserted into any of the plurality of slots to accommodate the different sizes of belts and a police or military holster rotatably attached to the backing plate.

12 Claims, 4 Drawing Sheets

CARRYING CASE FOR POLICE OR MILITARY EQUIPMENT

FIELD

The field relates to carrying cases used for police and military equipment and more particularly to cases supported by the belt or from loops sewn into the clothing of police or military personnel and that carry essential equipment (e.g., batons, flashlights, etc.).

BACKGROUND

Police and military personnel are required to carry a great deal of equipment. While firearms may be essential for protection in some cases, there is also a need to carry non-lethal weapons and support equipment.

For example, a baton may be necessary to subdue an opponent in a crowded area where a firearm could not be used for fear of injuring innocent people. Similarly, even where a firearm is appropriate, a flashlight may also be necessary at night or in dark buildings in order to have any chance of detecting and striking an armed adversary. When injured or outnumbered, a radio may be necessary to call for backup. It may also be necessary to carry spare batteries when operating for extended periods in the dark or alone or in remote areas.

Because of the nature of the environment in which police or military personnel operate, weapons and support equipment must be close at hand or otherwise readily available to defend against an attack. This is usually accomplished by a holster or some other container attached to the belt of a user.

Also because of the environment, holsters or other containers for support equipment must be rugged yet lightweight and not prone to snagging on obstacles. For example, a police officer chasing a suspect through brush could be slowed by heavy containers or snagging on the brush. Worse yet, if a container should become lost or damage by impact, a weapon or other equipment may not be available when the officer is in most need of that weapon or other support equipment.

While many devices exist for carrying weapons and other support equipment, they are often limited in how they can be used, attached to or otherwise carried by the police officer or military person. Accordingly, a need exists for more flexible options in such contexts.

DETAILED DESCRIPTION OF AN ILLUSTRATED EMBODIMENT

Figure 1A:
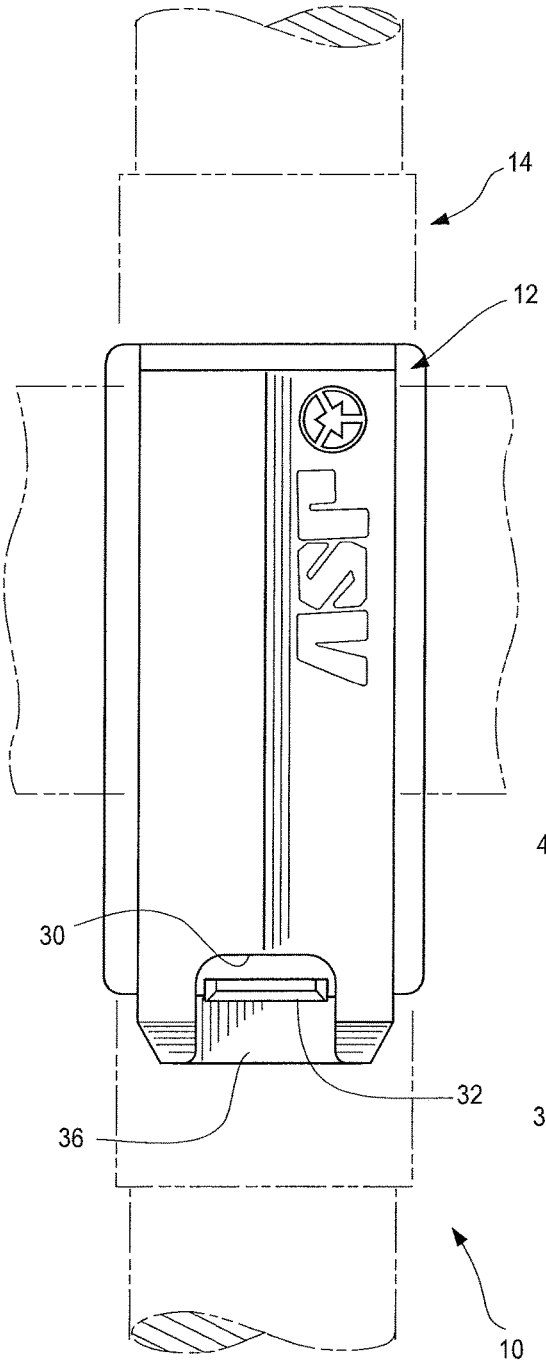
FIGS. 1A-B depict front and side view of a holster system shown generally in accordance with an illustrated embodiment.

While embodiments can take many different forms, specific embodiments thereof are shown in the drawings and will be described herein in detail with the understanding that the present disclosure is to be considered as an exemplification of the principles hereof, as well as the best mode of practicing same. No limitation to the specific embodiment illustrated is intended.

Figure 1B:
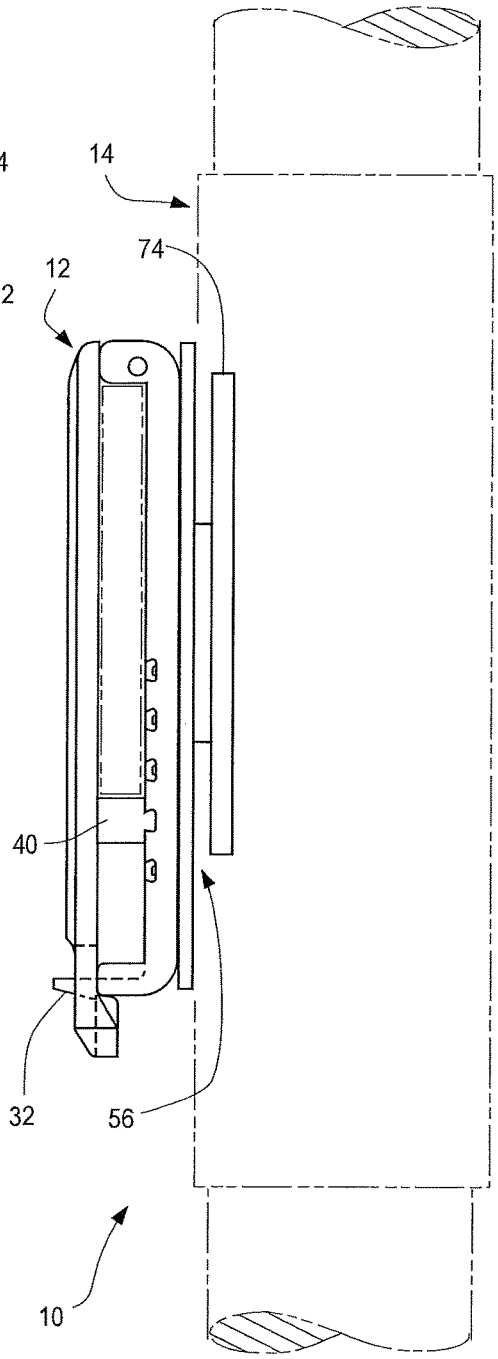

FIG. 1 depicts front and side views of a holster system 10 that may be attached to the belt of clothing of a police officer or military person. The system includes the holster or other container (hereinafter simply a holster) 14 and a clip 12 that supports the holster from the belt or clothing of the police officer or military person. The holster may comprise a flexible fabric or plastic.

The holster system may be structured in any of a number of different configurations to carry a number of different types of equipment. Under one illustrated embodiment, the holster may be configured as a baton carrier including a central tubular structure with apertures on the top and bottom and a slot along one side for the quick removal of the baton from the holster. Alternatively, the holster may be a tubular structure with a closed bottom for carrying a flashlight. In other embodiments, the holster may have a box like structure with a fixed or flexible lid including a hinge on the upper clip side of the holster and a flap that folds down over the top of the holster or container and a distal end that can be secured to an attachment point on the outside opposing half of the holster of FIG. 1.

Figure 2:
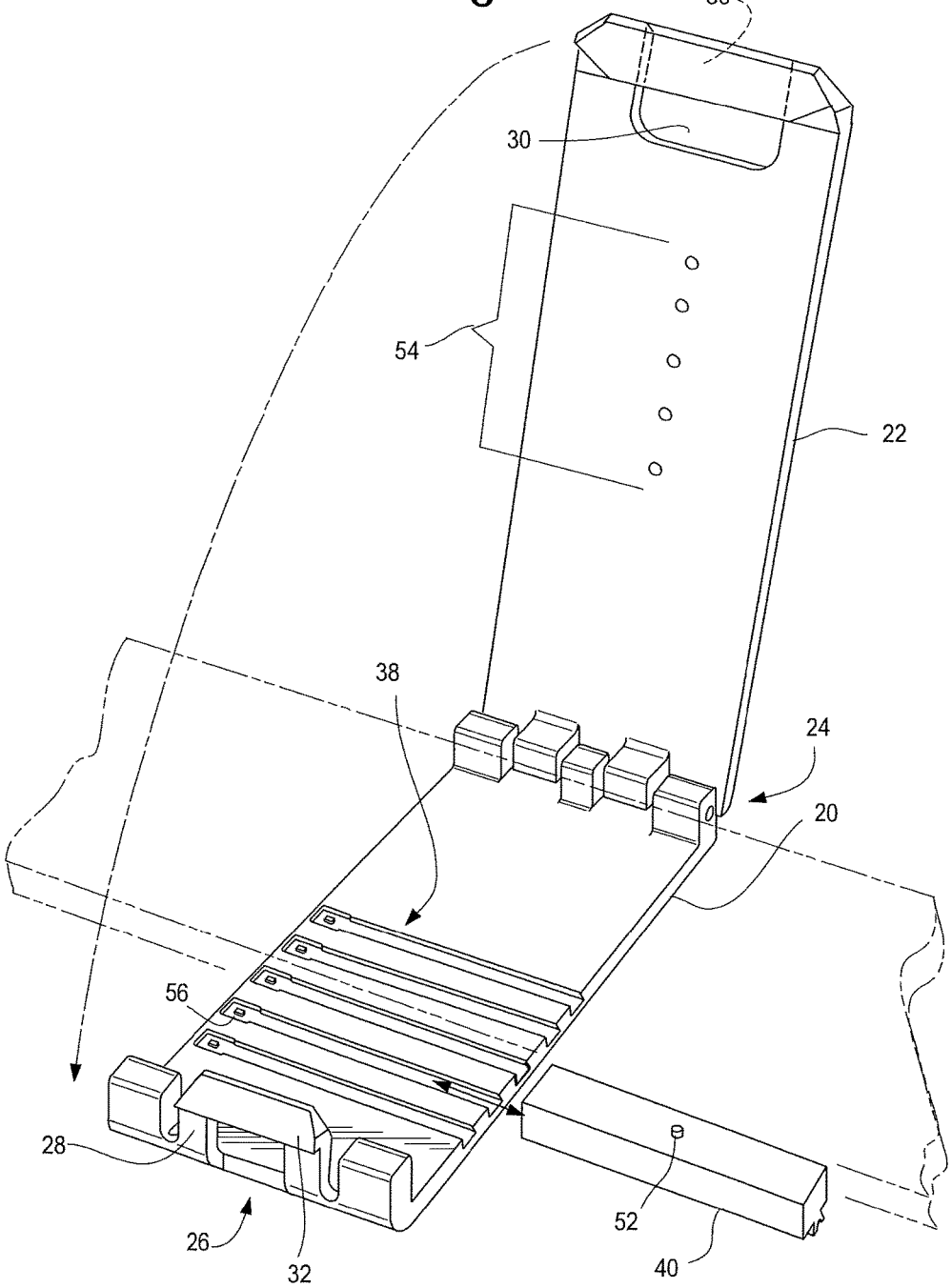
FIG. 2 depicts a perspective view of the clip of the system of FIG. 1.

FIG. 2 is a side perspective view of the clip 12 in the opened position. As shown in FIG. 2, the clip generally includes an elongated mounting or backer plate 20 and cover plate 22. The mounting plate and elongated cover plate are joined at a first longitudinal end by a hinge 24. A resilient lock 26 including a locking arm 28 and aperture 30 on a second end secures the second ends of the mounting and cover plates together around an article of clothing (e.g., a belt, a loop on a moly vest, etc.).

Figure 3:
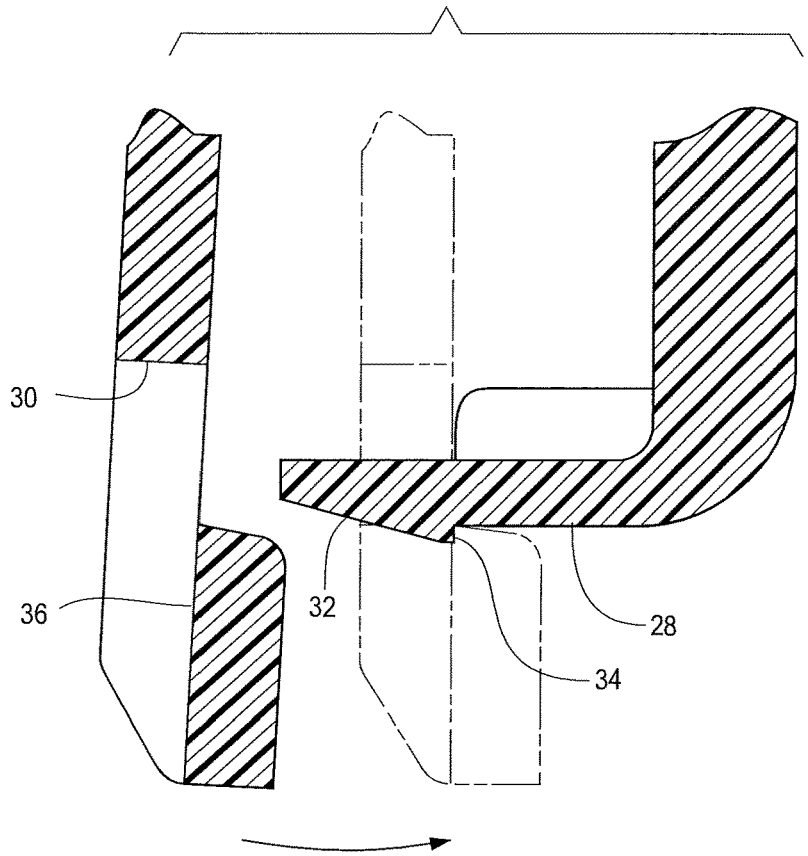
FIG. 3 depicts details of a resilient lock used by the system of FIG. 1.

FIG. 3 is a cut-away side view of the second end of the mounting and cover plates showing details of the resilient lock 26. Extending outwards on a proximal end from the mounting plate is the resilient arm 28. As shown in FIG. 3, the resilient arm has a catch on a distal end. The catch includes a ledge 34 extending perpendicularly outwards on a proximal end from the distal end of the arm. A top of the catch has a sloping surface 32 that slopes outwards from the marginal edge of the distal end of the arm to the margin edge of the distal end of the ledge.

As may also be noted from FIG. 3, the catch of the distal end of the resilient arm is offset from the aperture 30 at least by the length of the ledge. Because of the offset, when the cover is folded from the hinge side against the mounting plate, the sloping surface engages the distal side of the aperture thereby causing the resilient arm to deflect inwards from the second end towards the first end. As the arm deflects, the catch on the end of the arm eventually deflects and enters the aperture.

As the catch reaches the far end of the aperture on the outside of the cover plate, the resilient arm automatically springs outwards to its undeflected position. In the undeflected position, the arm resides against the side of the aperture nearest the second end of the cover plate. As the catch exits the aperture, the ledge also engages the outside surface 36 on the back of the cover plate thereby preventing the accidental opening of the clip.

To release the resilient lock, a user may place the first end of the clip in the palm of his/her hand, place his/her thumb on the sloping surface and pull the sloping surface towards the first end to deflect the resilient arm. Once the ledge clears the back surface of the cover plate, the user simply pushes the arm back through the aperture to open the clip.

Figure 4:
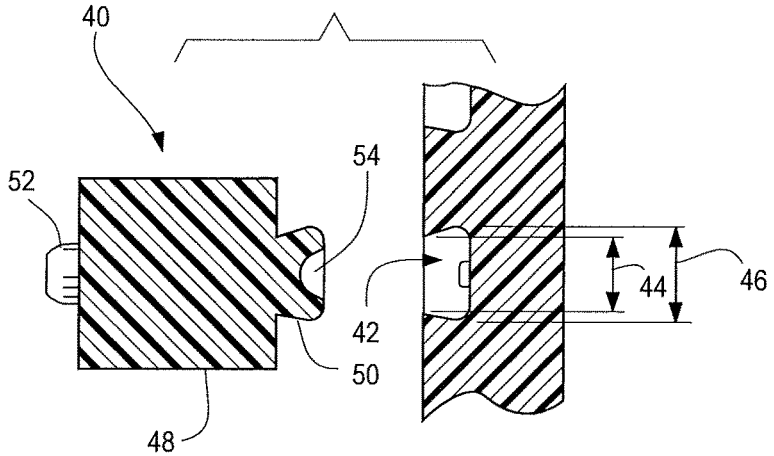
FIG. 4 depicts details of a spacer used by the system of FIG. 1.

Also included on the mounting plate is a number of slots 38 (FIG. 2) extending across the mounting plate, perpendicular to the longitudinal axis. Installed within one of the slots is a spacer 40. FIG. 4 is an exploded view of a cross-section of one slot 42 of the slots 38 and of the spacer shown in FIG. 2. In this regard, the cross section of FIG. 4 is in a direction that is parallel to the longitudinal axis of the mounting plate. As may be noted from FIG. 4, the width 46 of the cross section at the root of the slot is greater than the width 44 at the entry of the slot.

As also shown in FIG. 4, the spacer has a slot engaging portion 50 that is joined at a proximal end to a spacer portion 48. In this regard, the spacer portion may be sized to snugly fit between the mounting and cover plates when the cover plate is locked to the mounting plate.

The cross section of the slot engaging portion of the spacer is complementary to the cross section of the slot. That is, the width of the cross section at the distal end of the slot engaging portion is somewhat smaller (e.g., by a few tenths of a millimeter) than the width of the root of the slot. Similarly, the width of the proximal end of the slot engaging portion is a somewhat smaller (e.g., by a few tenths of a millimeter) than an entry width of the slot.

In general, the spacer 40 is inserted into any one of the slots from an edge of the clip (as shown by the arrow in FIG. 2) transverse to the longitude of the mounting plate. In this regard, a user may grasp the spacer from a proximal end and insert the distal end into one of the slots. Since the cross section of the slot engaging portion of the spacer is somewhat smaller than the cross section of the slot, it could be expected that the spacer could fall out of the holster system and be easily lost. However, the holster system offers a number of features that prevent this possibility from happening.

For example, the slots could be closed on one end. For example, FIG. 2 shows that each of the slots are closed on the left side of FIG. 2.

Another feature that prevents the spacer from being lost may be a peg 52 extending from the top of the spacer. The peg engages one of a plurality of apertures 54 in the inside surface of the cover plate. In this regard, each of the apertures is centered over a corresponding slot. As such, when the spacer is inserted into a slot and the cover plate is folded over the spacer, the peg engages the aperture over that slot thereby locking the spacer into that slot at least until the clip is again opened.

Another feature that prevents loss of the spacer is a detent that secures the spacer within the slot. The detent may include a bump 56 centered on the blind end of each slot as shown in FIG. 2 that is engaged by a dimple 54. As such, once the spacer is inserted into a slot, it is held in the slot by the detent.

Figure 5:
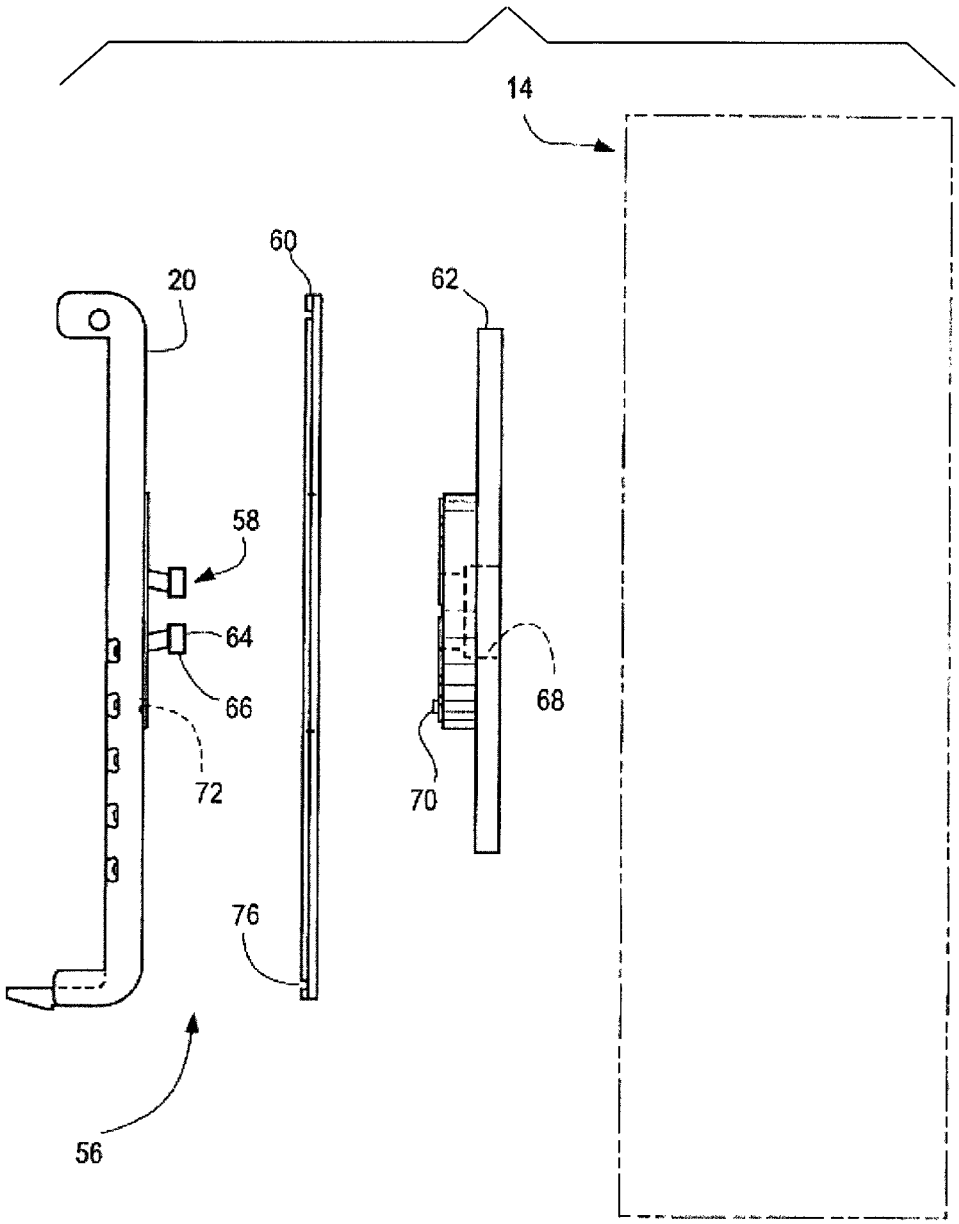
FIG. 5 depicts details of a rotatable joint used by the system of FIG. 1.

FIG. 5 shows a simplified exploded view of the holster system showing a pivoting joint 56 used to join the clip 12 to the holster 14. The pivoting joint may include a hub 58, a flexible diaphragm 60 and retaining plate 62. In this case, a post 64 with an outer lip 66 extends through the diaphragm and aperture 68 in the retaining plate. The lip engages a distal side of the retaining plate thereby attaching the retaining plate and diaphragm to the mounting plate. A post 70 in the retaining plate engages a slot 72 in the mounting plate to allow a rotation of only 90 degrees from either side of the center position shown in FIG. 1.

The diaphragm may be constructed from any of a number of flexible materials (e.g., hypalon). In general, the diaphragm has a greater length and width than the retaining plate. This allows an outer periphery of the diaphragm to be joined to the holster 14 via an appropriate connection material (e.g., thread 74). In this regard, a channel 76 may be routed along the edge of the diaphragm and through which the diaphragm may be sewn to the holster 14.

In addition, the diaphragm may have a receptacle molded into the diaphragm that prevents rotation of the retaining plate relative to the diaphragm (e.g., the receptacle and retaining plate may both be oblong). Alternatively, the retaining plate may be attached to the diaphragm via an appropriate joining device(s) (e.g., rivets, glue, etc.) to prevent rotation.

In general, the holster system provides a reliable means of carrying police or military equipment that is less likely to be lost or damaged. For example, the moveable spacer 40 may be inserted into any one of the slots 38 depending upon the width of the belt on which it is used. The resilient lock virtually eliminates the possibility that the clip could accidentally opened. Similarly, the post and slot combination in the rotatable joint that prevents rotation of more than 90 degrees prevents the holster from being rotated far enough for the equipment carried in the holster to accidentally fall out.

In general, the holster system includes an elongated backer plate having a plurality of mutually parallel, spaced-apart slots extending from a midpoint towards one of the ends, each extending across the backer plate transverse to the longitudinal axis and having a constant cross section with a root end relatively wider than an opposing, open end, an elongated cover plate, a hinge that pivotally connects a first end of the backer plate to a first end of the cover plate, a resilient lock that releasably connects a second end of the backer plate to the second of the cover plate, an adjustable spacer located between the backer plate and cover plate, the adjustable spacer having a slot engaging portion extending from the adjustable spacer that is complementary to the cross section of each of the plurality of slots wherein a space between the backer plate, the cover plate, the hinge and resilient lock is adapted to accept a range of different sizes of belts worn by a human user and wherein the adjustable spacer may be inserted into any of the plurality of slots to accommodate the different sizes of belts and a police or military holster rotatably attached to the backing plate.

In alternate embodiments, the holster system includes an elongated mounting plate having a plurality of slots transverse to the longitudinal axis, the slots together extending from a center towards one end, the slots each have a constant cross section along a length of the slot with a wider root end than open end, an elongated cover plate, a hinge that pivotally connects a first end of the mounting plate and cover plate, a resilient lock that releasably connects a second end of the mounting plate and cover plate, an adjustable spacer located between the mounting plate and cover plate having a slot engaging portion that is complementary to the cross section and that engages one of the plurality of slots between the mounting plate and cover plate, wherein a space between the mounting plate, the cover plate, the hinge and resilient lock is dimensioned to accept a range of different sizes of belts worn by a human user and wherein the adjustable spacer may be inserted into one of the plurality of slots to accommodate a corresponding size of belt and a holster attached to the mounting plate that accepts a baton or flashlight.

In still other embodiments, the holster system includes an elongated backer plate, the backer plate having spacers extending across a width of the backer plate on opposing longitudinal ends of the elongated backer plate with a proximal end of each of the spacers extending outwards from the backer plate perpendicular to the length and width of the backer plate, the backer plate further having a plurality of slots extending across the width of the backer plate perpendicular to the longitudinal axis and located on an inside surface of the backer plate that is between the spacers on opposing ends, the plurality of slots are spaced apart on the backer plate from near a midpoint of the longitudinal axis towards one of the ends of the backer plate, each of the slots has a constant cross section extending across the width of the backer plate with a root end of the cross section relatively wider than an opposing, open end on the inside surface of the backer plate, an elongated cover plate extending between distal ends of opposing spacers of the backer plate, a hinge that joins the distal end of the spacer on one end of the back plate with the cover plate on a first end of the backer plate and cover plate, a resilient lock extending from the distal end of the spacer on a second end of the backer plate through with a locking surface of the resilient lock engaging a back surface of the cover plate that faces away from the backer plate, an elongated adjustable spacer extending between the backer plate and cover plate, the adjustable spacer having a slot engaging portion extending along the length of the adjustable spacer that is complementary to the cross section of each of the plurality of slots wherein a space between the backer plate and cover plate between the pair of spacers is adapted to accept a range of different sizes of belts worn by a human user and wherein the adjustable spacer may be inserted into any of the plurality of slots to accommodate the different sizes of belts and a holster for a baton or flashlight coupled to the backing plate.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus comprising an elongated backer plate having a plurality of mutually parallel slots spaced-apart along a longitude of the backer plate from a midpoint towards one of the ends, each extending across the backer plate transverse to the longitudinal axis and having a constant cross section in longitude with a root end relatively wider than an opposing, open end;

an elongated cover plate;

a hinge that pivotally connects a first end of the backer plate to a first end of the cover plate;

a resilient lock that releasably connects a second end of the backer plate to the second end of the cover plate;

an adjustable spacer located between the backer plate and cover plate, the adjustable spacer having a slot engaging portion extending from the adjustable spacer that is complementary to the cross section of each of the plurality of slots wherein a space between the backer plate, the cover plate, the hinge and resilient lock is adapted to accept a range of different sizes of belts worn by a human user and wherein the adjustable spacer may be inserted into any of the plurality of slots to accommodate the different sizes of belts; and a police or military holster fabricated from a flexible fabric, the holster further including an adapter plate rotatably attached to the backer plate and a diaphragm disposed between the adapter plate and mounting plate and sewn to the flexible fabric of the holster around a periphery of the adapter plate.

2. The apparatus as in claim 1 wherein each of the plurality of parallel slots further comprise one open end and one closed end.

3. The apparatus as in claim 1 wherein each of the plurality of slots further comprising a detent within each of the slots that releasably secures the adjustable spacer within the slot.

4. The apparatus as in claim 1 further comprising an aperture within the cover plate directly over each of the slots and a peg extending from an upper surface of the adjustable spacer, such that when the adjustable spacer is inserted into one of the plurality of slots and the cover plate is locked to the backer plate, the peg is engaged by the corresponding aperture thereby preventing the adjustable spacer from moving within the one slot until the cover plate is released.

5. The apparatus as in claim 1 wherein the holster further comprises a baton holder.

6. The apparatus as in claim 1 wherein the holster further comprises a flashlight holder.

7. An apparatus comprising an elongated mounting plate having a plurality of mutually parallel slots transverse to the longitude, the slots are spaced apart along the longitude from a center towards one end, the slots each have a constant cross section along a length of the slot with a wider root end than open end;

an elongated cover plate;

a hinge that pivotally connects a first end of the mounting plate and cover plate;

a resilient lock that releasably connects a second end of the mounting plate and cover plate;

an adjustable spacer located between the mounting plate and cover plate having a slot engaging portion that is complementary to the cross section and that engages one of the plurality of slots between the mounting plate and cover plate, wherein a space between the mounting plate, the cover plate, the hinge and resilient lock is dimensioned to accept a range of different sizes of belts worn by a human user and wherein the adjustable spacer may be inserted into one of the plurality of slots to accommodate a corresponding size of belt; and a flexible fabric holster that accepts a baton or flashlight, the holster further including an adapter plate rotatably attached to the mounting plate and a diaphragm disposed between the adapter plate and mounting plate and sewn to the flexible fabric of the holster around a periphery of the adapter plate.

8. The apparatus as in claim 7, wherein the diaphragm comprises a synthetic rubber sheet.

9. The apparatus as in claim 7 wherein the resilient lock further comprises a locking peg carrying a locking surface that engages an outside surface of the cover plate on a side of the cover plate that faces away from the mounting plate.

10. The apparatus as in claim 9 further comprising an aperture extending through the cover plate on the second end, wherein a tapered distal end of the locking peg deflects into the aperture as the cover plate is closed over the locking peg and as the cover plate fully closes, the locking surface of the locking peg engages the outside surface.

11. The apparatus as in claim 7 wherein the adjustable spacer further comprises a length substantially equal to a width of the mounting plate.

12. The apparatus as in claim 7 wherein each of the plurality of slots further comprise a closed end with a bump extending from a bottom of each slot proximate the closed end that engages a dimple on a bottom of the adjustable spacer upon insertion of the adjustable spacer into the slot through an opposing end.

* * * * *